United States Patent [19]

Gordon

[11] Patent Number: 4,581,271

[45] Date of Patent: Apr. 8, 1986

[54] HOLDER AND INDICIA MEANS FOR USE THEREWITH

[76] Inventor: Richard A. Gordon, 95 W. 3rd St., Freeport, N.Y. 11520

[21] Appl. No.: 655,564

[22] Filed: Sep. 28, 1984

[51] Int. Cl.[4] ..... B44C 1/28; G09F 3/20; G09F 21/02

[52] U.S. Cl. ..... 428/67; 40/21 C; 40/5; 40/586; 40/618; 2/311; 63/2; 63/3

[58] Field of Search ..... 428/31, 67, 187, 131; 40/5, 304, 21 C, 21 R, 6, 618, 622, 306, 596, 611, 10 C, 586; 2/311, 338; 63/29 R, 1 A, 2, 3, 11, DIG. 3; 434/159, 171, 172

[56] References Cited

U.S. PATENT DOCUMENTS

| | | | |
|---|---|---|---|
| 440,306 | 11/1890 | Durning | 40/303 |
| 1,703,857 | 2/1929 | Hamilton | 40/622 |
| 1,706,957 | 3/1929 | Corbitt | 40/622 |
| 4,137,660 | 2/1979 | Dettmann et al. | 40/303 |
| 4,151,936 | 5/1979 | Hawkes | 224/224 |
| 4,340,976 | 7/1982 | Wright | 2/338 |
| 4,521,923 | 6/1985 | Mackey | 2/338 |

FOREIGN PATENT DOCUMENTS

| | | | |
|---|---|---|---|
| 0951870 | 3/1964 | United Kingdom | 40/6 |

*Primary Examiner*—John E. Kittle
*Assistant Examiner*—Thomas C. Saitta
*Attorney, Agent, or Firm*—Bauer & Amer

[57] ABSTRACT

A holder having a chamber that is recessed and has compartments in which indicia elements having engaging projections are received. The compartments have access openings in opposed walls of the chamber that are bendable to increase the size of the compartments for easy insertion of the indicia elements thereinto and removal of the same therefrom.

18 Claims, 6 Drawing Figures

HOLDER AND INDICIA MEANS FOR USE THEREWITH

The present invention relates to a holder and to indicia means for use therewith.

BACKGROUND OF THE INVENTION

Belts, bracelets, animal collars and the like frequently have been provided with structural details which enable them to display the initials and/or even the names and addresses of the wearer or user and perhaps other pertinent information.

For example, it is the practice in hospitals to immediately assemble beads and other indicia elements in the form of a bracelet that is applied to newborn infants to prevent confusion between them. In such instances, the indicia means are assembled on a string which, if not properly secured, breaks so that the beads fall off the string and become lost thereby defeating the purpose of the bracelet.

Hospital identification bracelets are known to contain a typewritten slip of paper which bears the desired information of the hospital patient. The need to type the information and subsequently assemble it in a pocket in the bracelet is time consuming and error prone. When many patients are being admitted to a hospital within a short period of time, there have been instances when the typed papers are mixed up and the patients are sometimes the recipients of the wrong bracelets.

Identification tags are also used for animals to assure their return to their owners when lost. In the past, such tags have been attached to the animal collar. Sometimes the tag becomes separated from the collar and oftentimes the tags are difficult to read because of the small lettering or because of the nature of the tags.

SUMMARY OF THE INVENTION

The present invention is directed to a simplified holder that may be used for many purposes, but principally in combination with indicia means that are capable of being assembled to the holder and disassembled from the same.

An object of the invention is to provide a holder and indicia means for use in combination in which the indicia means are so simple in detail as to enable its manufacture and subsequent use so easy that the same can be assembled on and disassembled from the holder quickly and easily without any technical knowledge or dexterity.

Another object of the invention is to provide a holder with compartments that receive, engage with and retain the indicia means assembled thereto against accidental displacement therefrom.

Still another object of the invention is to provide the holder and indicia means in such simplified detail that the same may be made inexpensively, yet ornamentally attractive.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawing wherein:

Figure 1:
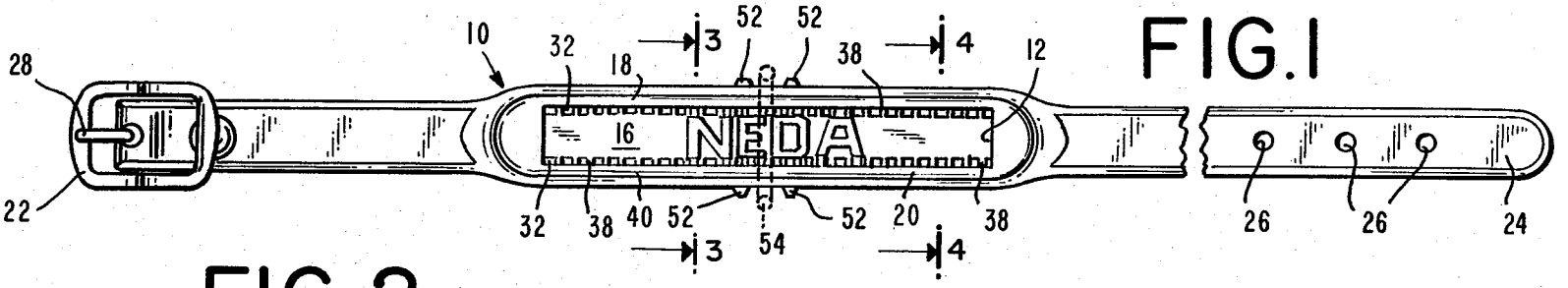
FIG. 1 is a front elevational view of a strap type holder having indicia means in accordance with the teaching of the invention.

Referring now to the drawing and more particularly to FIGS. 1 to 4 thereof, the details show a holder that is generally identified by the numeral 10. The holder 10 is provided with a chamber 12 which can be seen more clearly in FIG. 4. The chamber 12 is elongated in length with respect to the width thereof and is defined in part along its length by a base 14 having a substantially planar surface 16 as can be seen more clearly in FIGS. 3 and 4 that is recessed below and with respect to oppositely disposed relatively spaced side walls 18 and 20 that border along and define the opposite elongated sides of the chamber 12. If desired, although necessary, the outer surface of the base member 14 may also be substantially planar in the same manner as is the surface 16.

Figure 2:
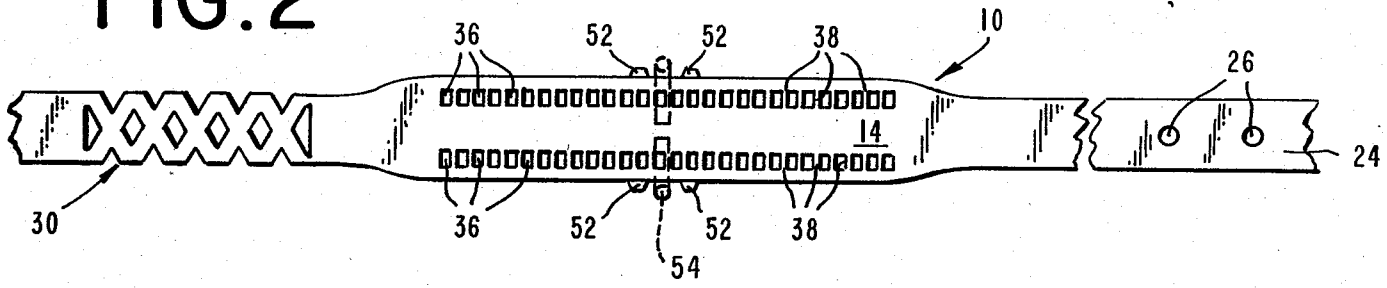
FIG. 2 is a rear view of the holder shown in FIG. 1 but illustrated with a different strap.
Figure 4:
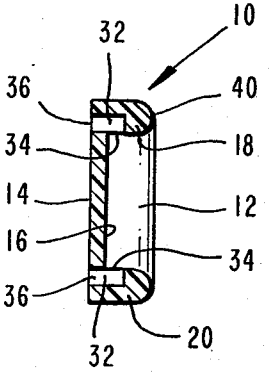
FIG. 4 is a cross section of FIG. 1 taken along lines 4—4.
Figure 3:
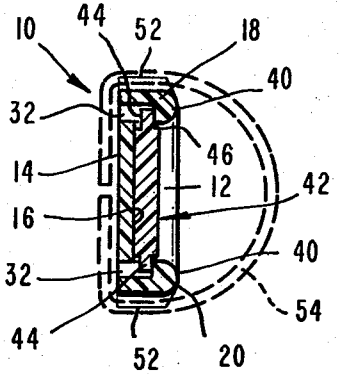
FIG. 3 is a cross section of FIG. 1 taken along lines 3—3.

Before proceeding further with the description of the holder 10, it will be clear from a review of FIGS. 1 and 2 that the structural details of the holder 10 may be applied to any type of device. Thus, for example, in FIG. 1 the device thereshown is in the form of a strap which has a buckle 22 at one end and a tongue extension 24 at its other end which is provided with a plurality of holes 26 into which the locking tab 28 of the buckle 22 may extend. Thus, when the tongue 24 is extended through the buckle 22 about either the waist of a wearer or about the wrist of a wearer, or even about the collar or neck of an animal, the holder 10 may function as an identification belt or bracelet or collar, as the case may be.

It will be clear to one who is skilled in the art that there is no limit upon the end uses with which the present inventive teaching may be used and to which it may be applied. In this regard, the reader's attention is directed to the structural details of the strap shown in FIG. 2 wherein the same may have an elasticized or expandible lengthwise portion 30 which permits the strap to which the holder is applied to function in any desired manner without affecting the integrity and structural details of the holder 10.

Provided in the holder structure 10 are a plurality of side by side relatively spaced engagement compartments 32 which extend laterally or in the widthwise direction into the opposed side walls 18 and 20. Each compartment 32 has an access opening 34 that opens into the interior of the recessed chamber 12. Each compartment 32 also has an access opening 36 which extends in the direction of and through the base 14.

Each of the engagement compartments 32 is equally spaced from the other in the lengthwise direction of the recessed chamber 12 by separating walls 38 as can be seen more clearly in FIGS. 1 and 2. The bordering walls 38 which define the sides of each of the engagement compartments 32 function in the manner to maintain the compartments in equally spaced relationship and also to subsequently engage with the indicia means that are assembled in the engagement compartments 32 in the manner to be described.

In practice, it has been found that the holder 10 and its attendant strap or belt or collar-like structure of which it forms a part may be molded in a single molding operation with the compartments 32 being formed during the molding operation. The material of which the holder 10 is made may be of a plastic which, if properly contoured such as at the curves 40 illustrated in FIGS. 3 and 4, may permit predetermined controlled flexing movement of the walls 18 and 20 when the chamber 12 is bent in the direction of its length. Thus, it has been found that by properly dimensioning the thickness and curvature of the walls 18 and 20, it is possible to make the walls more or less flexible.

Hence, when the holder 10 is bent in the direction of its length, depending upon the flexibility of the walls 18 and 20, the same will tend to bow laterally outward in a direction away from each other thereby increasing the widthwise relative space between the walls 18 and 20 so as to cause the access openings 34 of the compartments 32 to become partially uncovered and more visible when viewed in the direction of the front or plan view of FIG. 1. This widthwise or lateral increase of the relative space between the walls 18 and 20 now makes it easier to apply the indicia means illustrated in FIGS. 5 and 6 into the compartments 32 of the holder 10 or to disassemble the same from their compartments in the manner to be described.

Figure 5:
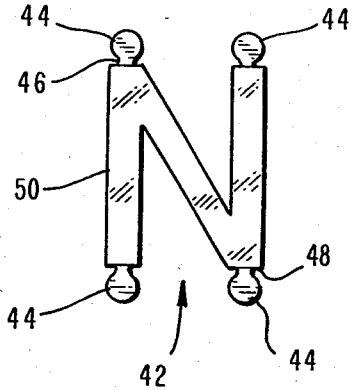
FIG. 5 is an enlarged plan view of an indicia means constructed according to the invention.

Referring now to the indicia means generally identified by the numeral 42 in FIG. 5, the same is shown in the form of the letter "N." The letter N has merely been selected because of ease of illustration and description of the details of the indicia means. The mere illustration of the letter N should not, however, be considered as a limitation upon the scope of the invention, since it should be apparent from a description of the invention how the inventive details of the same may be applied to all other letters and numerals or any other form of indicia that may be intended to be used in combination with the holder 10.

The indicia means 42 is provided with a plurality of two or more relatively spaced engaging projections 44 formed unitary therewith on opposite sides thereof. It will be noted that the widthwise extent from the shoulders 46 and 48 is substantially equal to but slightly less in expense than the lateral spacing or width between the walls 18 and 20 from each other. This is illustrated more clearly in FIG. 3 wherein the indicia means 42 has already been positioned within the compartment 12 of the holder 10 and it will be seen that there is a slight space between the adjacent surfaces of the walls 18 and 20 and the shoulders 46 and 48, so that there is a slight play between the indicia means 42 in the lateral or widthwise direction of the chamber 12 of the holder 10 so as not to prevent the holder from flexure that enables it to conform to the contour to which it is applied.

Although the holder 10 is made of a soft or relatively flexible or bendable material, the indicia means 42 may be molded of a much more rigid and less flexible material so that the indicia means 42 tends not to flex or bend or yield as freely and easily as the holder 10 along its widthwise expanse from the shoulders 46 to 48 or its lengthwise expanse from one side 50 to the other. When the holder 10 is bent and the walls 18 and 20 bow slightly outward away from each other and the compartments 32 are slightly uncovered during such bending, the engaging projections 44 may easily be inserted into the partially uncovered matching and correspondingly spaced engagement compartments 32 through their respective access openings 34.

Since the compartments 32 and the engaging projections 44 are equally and correspondingly spaced, their matching relationship is accomplished readily and easily. One set of the projections 44 are positioned into the compartments 32 defined within the wall 18. The other set of projections 44 at the opposite widthwise shoulders of the indicia means 42 are inserted into compartments 32 defined within the wall 20. When so positioned, the holder is again returned to its normally flat condition during which the walls 18 and 20 are now positioned straight once again so that the engagement compartments 32 are no longer uncovered and the projections 44 of the indicia means are positioned within their respective engagement compartments.

A review of the embodiment shown in FIG. 5 illustrates the engaging projections 44 being of substantially bulbous appearance with curved sides, the relative widthwise spacing of which is substantially equal to the relative lengthwise extent of the defining walls 38 of the engagement compartments 32. Because the bulbous projections 44 are substantially the same in widthwise dimension as is the lengthwise expanse or extent of the compartment 32, the sides of the bulbous projections make line contact engagement with the spacing walls 38 forming the compartments 32 so as to prevent accidental separation of the indicia means and displacement of the same from their respective compartments even when the holder 10 is thereafter flexed or bent and the compartments are partially uncovered by their respective walls 18 and 20. The substantial line engagement between the projections 44 and the side defining walls 38 of the compartments 32 is sufficient to retain the indicia means locked in position within the compartments 32 until such time as the indicia means are deliberately physically removed from such engagement.

Figure 6:
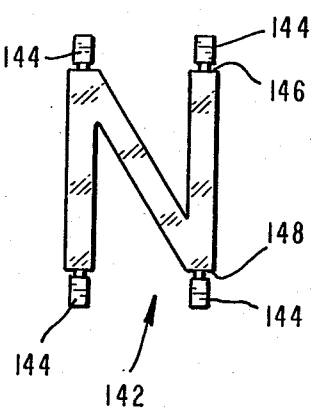
FIG. 6 is an enlarged plan view of another indicia means constructed according to the invention.

The embodiment shown in FIG. 6 is generally identified by the numeral 142 because its details correspond in substantial identity with the details just described with respect to the embodiment of the indicia means 42. The only difference between the two embodiments of the indicia means lies in the shape or configuration of the engaging projections 44 and 144.

In the embodiment 142, the engaging projections are substantially straight sided to correspond with the substantially straight sides of the separating walls 38 which separate the compartments 32 from each other. The indicia means 142 is utilized in the same manner as was described with respect to the indicia means 42. However, when the indicia means 142 is applied to and assembled in their respective engaging compartments 32 of the holder 10, the straight sides of the projections 144 made surface to surface contact and engagement with the substantially straight sides of the separating walls 38 of each of the compartments 32.

This straight sided surface-to-surface engagement provides a greater frictional engagement between them which inhibits and prevents the possibility of the indicia means 142 from being displaced or disassembled from their respective compartments 32 until such time as they are physically removed from engagement therewith by one who desires to change the indicia elements for others. Although the frictional engagement between the projections 44 and 144 and the walls 38 permits relative flexing and bending movement between the indicia means 42 and 142, in the event the same should render it difficult to remove the indicia means from their compartments, access to the same for their dislodgement may be had by way of the openings 36.

From what has been described, it should be clear that the holder 10 may be made of any desired length and that it may have any number of chambers 32 strung together in alignment with each other or arranged in adjacent rows with respect to each other. Although the indicia means 42 and 142 have been shown as letters for explanatory purposes only, it should be apparent to those skilled in the art that the indicia means may also be numerals and could possibly be other symbols as well. Hence, the invention must not be limited by the illustration of the indicia means shown in FIGS. 5 and 6.

The versatility of the present invention is illustrated by the provision of relatively lengthwise spaced stops 52 molded on opposite sides of the holder member 10 as is illustrated more clearly in FIGS. 1 and 2. The stops 52 provide abutments for a substantially D-shaped ring 54 which may be used to connect the swivel hook on the end of an animal leash to the holder 10 to transform the holder 10 and its strap type extensions into an animal collar.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a monolithic holder formed of a single layer of material for indicia means comprising a chamber defined in part along its length with a base having a substantially planar surface recessed below and with respect to oppositely disposed relatively spaced walls bordering opposite sides of said chamber defining an opening of one size into said chamber and facing said base, a plurality of side-by-side relatively spaced compartments extending into said opposed walls with each said compartment having an access opening into said chamber of one size, said monolithic single layer chamber walls and base being of a bendable material, said monolithic holder of a single layer of material being bendable in the area of said chamber, and said walls flexing in response to the bending of said holder and increasing their relative spacing and said chamber opening to another size to enable easy insertion of indicia means into said compartment access openings and removal of indicia means therefrom.

2. In a holder for indicia means as in claim 1, said chamber being elongated and said holder being a strap having means therealong for cooperation to releasably close the ends of said strap.

3. In a holder for indicia means as in claim 2, said plurality of relatively spaced compartments each having an opening extending through said base to each of said compartments.

4. In a holder for indicia means as in claim 2, a loop shaped element encircling and movable relative to said strap between the ends thereof, and means on said strap defining a space therealong along which said element has limited movement relative to said strap.

5. A holder for indicia means and indicia means therefor, comprising a chamber defined in said holder having an opening defined by relatively spaced oppositely disposed bendable walls, a plurality of relatively spaced side-by-side compartments in said chamber each having an access opening beneath and covered by said oppositely disposed walls, said holder being monolithic of a single layer of material selectively bendable in the area of the access openings of selected compartments, said walls being bendable with the bending of said holder to uncover said access openings of said selected compartment, indicia means for use with said holder, said indicia means being substantially unbendable with respect to said holder and having a plurality of relatively spaced engaging projections on opposite ends thereof, the relative spacing of the plurality of engaging projections on each of the opposite ends of said indicia means corresponding to the relative spacing of said compartments for interfitting projection thereinto through said access openings thereof without bending said indicia means and engaging projections relative to each other and for engagement therewith within the respective wall of each said compartment when said access openings are uncovered.

6. A holder for indicia means and indicia means therefor, as in claim 5, each said engaging projection and compartment being of a width to be in side-by-side engagement with each other to prevent accidental separation thereof.

7. A holder for indicia means and indicia means therefor, as in claim 5 said engaging projections being substantially bulbous with curved sides for engagement with said compartments.

8. A holder for indicia means and indicia means therefor, as in claim 5, said engaging projections and compartments having substantially straight sides for surface-to-surface contact and engagement with each other.

9. Indicia means and a holder therefor comprising a plurality of substantially planar indicia members having indicia means each being of substantially equal width, length and thickness, at least two engaging means projecting substantially equally from the opposite ends of each of said members, said engaging means substantially equally spaced from each other along the length of each of said members and being substantially in the plane thereof, said indicia member being substantially unbendable, and a single layered flexible holder having an elongated recessed chamber defined by walls bordering an opening, and compartments in said chamber, the width of said opening of said walled chamber being smaller than the width of said indicia means, said walls covering access to said compartments through said opening, said covering walls being flexible and increasing the width of said chamber opening to substantially the width of said indicia means to provide assembling access of said engaging means of said indicia members into said compartments and disassembly of the same therefrom without substantially bending said indicia members.

10. Indicia means and a holder therefor as in claim 9, said holder having opposite side walls each having a plurality of compartments divided by relatively lengthwise spaced walls in correspondence with said relative spacing of said engaging means to receive the same therein with at least a portion of each said side wall overlying each of said engaging means to retain the same in their respective compartments against accidental displacement therefrom.

11. Indicia means and a holder therefor as in claim 10, each of said compartments and engaging means being of substantially equal lengths such that their lengthwise surfaces are engaged against accidental displacement when said engaging means are in their respective compartments.

12. Indicia means and a holder therefor as in claim 11, said holder being bendable to flex said walls in a direction along their lengths.

13. Indicia means and a holder therefor as in claim 11, said holder including a base wall on which said indicia members are supported when retained in said compartments, and each compartment having an access opening in said base wall to provide access to said engaging means received in its respective compartment.

14. Indicia means and a holder therefor as in claim 12, said engaging means being substantially circular to provide line contact with said divider walls of said compartments.

15. Indicia means and a holder therefor as in claim 12, said engaging means being straight sided for full surface contact and engagment with the separating walls of said compartments.

16. The method of assembling substantially unbendable indicia members having indicia means and engaging means to a belt of bendable material having bendable walls defining an opening about a recessed chamber that has compartments covered by the unbent walls and in which the indicia engaging means are assembled and disassembled by bending the walls to uncover the compartments comprising bending the walls to uncover selected ones of the compartments, assembling a selected indicia member in the selected uncovered compartment by inserting the engaging means of the selected indicia member into the selected uncovered compartment without bending the indicia means and engaging means relative to each other, and releasing the bent walls to recover the selected compartment to cover the engaging means therein.

17. The method as in claim 16, wherein the selected indicia means is disassembled from said selected compartment while the compartment is uncovered by the bent walls without relatively bending the selected indicia means and its engaging means.

18. The method as in claim 17, bending the walls to uncover a selected compartment by bending the belt in the vicinity of the selected compartment.

* * * * *